United States Patent [19]

Hartman

[11] Patent Number: 4,997,314

[45] Date of Patent: Mar. 5, 1991

[54] PRESSURE GROUTED PIER AND PIER INSERTING TOOL

[76] Inventor: Philip L. Hartman, 2757 Comstock Cir., Belmont, Calif. 94002

[21] Appl. No.: 482,814

[22] Filed: Feb. 21, 1990

Related U.S. Application Data

[63] Continuation-in-part of Ser. No. 324,297, Mar. 15, 1989, Pat. No. 4,907,916.

[51] Int. Cl.[5] ..... E02D 5/62

[52] U.S. Cl. ..... 405/236; 405/269; 405/233

[58] Field of Search ..... 405/236, 233, 242, 232, 405/230, 241, 240, 269

[56] References Cited

U.S. PATENT DOCUMENTS

| | | | |
|---|---|---|---|
| 1,906,136 | 4/1933 | Dahren . | |
| 2,853,858 | 9/1958 | Mintz . | |
| 2,982,103 | 5/1961 | Revesz . | |
| 3,512,365 | 5/1970 | Muller | 405/236 |
| 3,796,055 | 3/1974 | Mahony . | |
| 3,852,970 | 12/1974 | Cassidy . | |
| 3,902,326 | 9/1975 | Langenbach, Jr. . | |
| 3,925,998 | 12/1975 | LeCorgne | 405/242 |
| 4,012,917 | 3/1977 | Gendron . | |
| 4,014,174 | 3/1977 | Mondshine | 405/253 |
| 4,070,867 | 1/1978 | Cassidy . | |
| 4,372,707 | 2/1983 | Ostgaard | 254/29 X |
| 4,474,243 | 10/1984 | Gaines | 405/230 |
| 4,673,315 | 6/1987 | Shaw | 405/230 |
| 4,708,528 | 11/1987 | Rippe | 405/230 |
| 4,711,603 | 12/1987 | Rippe, Jr. et al. | 405/230 |
| 4,738,568 | 4/1988 | Steding | 405/236 X |
| 4,808,038 | 2/1989 | Roberts et al. | 405/233 X |
| 4,907,916 | 3/1990 | Hartman | 405/236 |

*Primary Examiner*—Randolph A. Reese
*Assistant Examiner*—J. Russell McBee
*Attorney, Agent, or Firm*—Limbach, Limbach & Sutton

[57] ABSTRACT

An improved pipe pier inserting tool comprising at least two separate driving means, attached to two separate gripping means, whereby a pipe pier held within the gripping means can be forced, either in tandem or sequentially, by the two driving means into unstable soil beneath a building foundation so as to add new support.

14 Claims, 5 Drawing Sheets

1
2
3
4
4'
5
5'
6
7
8
9
10
11
12
13
14
15
15'
16
17
18
19
20
21

PRESSURE GROUTED PIER AND PIER INSERTING TOOL

RELATED APPLICATIONS

This application is a continuation-in-part of my application number 07/324,297, filed Mar. 15, 1989, now U.S. Pat. No. 4,907,916.

BACKGROUND OF THE INVENTION

This invention relates to an improved apparatus used for shoring building and other foundations, to a pressure grouted pier and to the method of forming that pier under such a foundation so as to add new support.

DESCRIPTION OF RELATED ART

The shoring of building foundations against settlement has long been practiced. For example, U.S. Pat. No. 2,982,103 describes a method of preventing building settlement by attaching a wall bracket to the building, driving a length of pipe into the ground, loading the pipe and then securing the wall bracket to the pipe to maintain the load on the pipe. In this method, the pipe to be used as a pier is forced into the ground by use of a hydraulic ram through an apertured load plate.

U.S. Pat. No. 3,796,055 also describes a method and apparatus for underpinning and raising portions of a building foundation. In this method a pit is dug alongside a foundation and a hydraulic drive means is positioned under the foundation to drive a pipe into the ground. A jacking pad is then formed and supported on the upper end of the pipe, which pad then can be used as a base to jack the foundation upwardly to the desired position. In this patent, the pipe is positioned parallel to and adjacent to the driving ram so the pipe may be fed continuously through the hydraulic drive means in sections as driving progresses.

U.S. Pat. No. 3,902,326 shows the use of a hydraulic ram positioned above and in line with a pipe which is driven through a member which is secured to a building foundation.

U.S. Pat. No. 4,708,528 likewise shows a wall mounted bracket through which a pipe pier is forced by use of a hydraulic ram, the ram being positioned above and in line with the pier to be driven.

U.S. Pat. No. 4,711,603 describes a method and apparatus for forcing a pier through a concrete slab. This method of stabilizing concrete slabs does not require securing the jacking means to a sidewall of the foundation.

U.S. Pat. No. 4,070,867 describes the use of a protective outer sleeve driven over a portion of a pile to isolate the pile from certain areas of the soil surrounding the pile.

U.S. Pat. No. 4,673,315 describes a pier inserting tool and method which includes dual hydraulic rams, which rams are connected between a fix plate/foundation support and a clamp surrounding the pier being driven.

U.S. Pat. No. 3,512,365 and U.S. Pat. No. 4,474,243 each describe the formation of cement containing pilings wherein cement is used both within the piling and surrounding it.

While the foregoing methods and apparatus have been used successfully, a number of drawbacks arise during their use. For example, as described in U.S. Pat. No. 2,982,103 it may be desireable to fill the pipe which has been inserted in the ground with cement grout and to surround the head of the pipe to form a zone of support. For this reason, it is advantageous to have access to the opening at the top of a pipe being driven so that such grout may be easily forced, under pressure, through and out of the pipe.

Unfortunately, many prior art apparatus mount the hydraulic ram in line with and immediately above the pipe being driven and necessarily block access thereto during the driving process. This is necessary to provide a balanced force against the pipe as it is driven. In U.S. Pat. No. 3,796,055, however, access to the pipe top is given by placing the ram adjacent to the pipe, but in line therewith. This orientation suffers from eccentric, and therefore unbalanced loading.

An additional problem of prior systems is that as lengths of pier pipe are forced into the ground and new lengths are positioned within the apparatus, loading and unloading of the pipe occurs. This constant loading and unloading places great stress on the foundation being lifted and can result in cracking thereof.

As mentioned, with most of the prior art methods, and with most of the prior art tools, hydraulic rams are utilized in one fashion or another. In such cases a tradeoff is present between how quickly the pier can be driven and how much force can be applied, at a given hydraulic pump driving pressure. Hydraulic pump capacity is usually limited since the pumps used with the equipment must be reasonably portable. If this was not the case, both the speed at which the equipment operates and the forces applied could be increased simply by using higher capacity pumps.

Not only are prior systems limited by pump capacity (and thereby either force available or speed of driving), but most have dead time between the time the pier is pushed and the time the driving ram is reset to its retracted position for its next stroke.

A further problem with prior art systems is that pier corrosion occurs where the pier is inserted into moist environments. Such corrosion can substantially reduce the effective life of a pipe pier.

It is therefore an object of the present invention to provide an apparatus for forcing a pipe pier into the ground in a manner which provides access to the pipe top for grouting while at the same time placing a balanced load on the pier. It is a further object of the invention to allow lengths of such pipe to be forced through the apparatus and into the ground while minimizing the jarring loading and unloading forces to the building foundation.

It is a further object of the invention to provide access to the pipe top as it is driven so that grout may be forced through the pipe and into the soil surrounding the head of the pipe as well as the outer length of the pipe, without having to unload the system to gain access to the pipe top.

It is still a further object of the invention to provide a tool design and method which more efficiently utilize hydraulic pump capacity so as to allow a greater driving force without having to slow the driving process down.

It is an additional object of the invention to provide a tool and method for driving pipe piers which can eliminate the reset dead time usually found with such devices.

In this manner a pipe pier which provides corrosion resistant long term added foundation support can be quickly and efficiently inserted.

SUMMARY OF THE INVENTION

Thus, the present invention provides a tool for inserting a pipe pier comprising a driving clamp and a stationary clamp, wherein the driving clamp is extendably attached to the tool's driving means, such as a hydraulic ram. The clamps are particularly designed to provide complementary one-way clamping of the pipe as it is driven so that the driving clamp holds the pipe as its is driven and the stationary clamp holds the pipe as the driving clamp is repositioned for its next stroke. The tool allows the pipe being inserted to be grouted as each length of pipe is driven. In a preferred embodiment, the pier inserting tool comprises at least two driving elements such as hydraulic rams, the driving elements being positioned so as to balance the forces exerted on the pipe as it is driven.

The invention further comprises a pressure grouted pier and the method of forming that pier whereby grout is forced through the pipe as it is driven and into a space formed surrounding the exterior of the pipe so as to sheath at least a portion of the length of the pipe exterior in protective grout.

The invention further includes a method of underpinning portions of a building foundation which may rest on unstable soil, the method comprising the steps of providing a pipe driver, mounting a means for supporting the pipe driver (such as a bracket) on the foundation or a wall adjacent the foundation, mounting the pipe driver on the means for supporting it, inserting a pipe into the pipe driver in a manner such that the pipe is aligned with the hole in the foundation, gripping the pipe within the driver using a first gripping means (such as a clamp), driving the pipe by forcing the first gripping means to an extended position, then releasing the first gripping means and retracting it, while a second gripping means holds the pipe in a loaded condition.

In a further apparatus embodiment, the invention is directed to a pier inserting tool having two extendable and retractable one-way clamps. In this embodiment the tool comprises a support frame, a first driving means mounted on the frame for driving a pipe along a pipe driving axis, a first clamp means for releasably clamping the pipe to be driven to an extendable/retractable portion of said first driving means, second driving means also mounted on said frame, and a second clamp means for releasably clamping to the pipe to be driven to an extendable/retractable portion of said second driving means wherein said first and second clamp means are each positioned along said driving axis and offset from one another.

BRIEF DESCRIPTION OF THE DRAWINGS

The invention will be described by reference to the figures attached of which.

DETAILED DESCRIPTION OF THE INVENTION

Where soil supporting a building foundation is found to be unstable, it is sometimes necessary to provide new support. Two main methods have previously been used. First, grout has been pumped under the structure in a quantity hopefully sufficient to displace unstable soil and maintain long term support. Second, pipe piers have been driven down through the unstable soil to find stable soil, or bedrock, and the pier is used to transmit the foundation load to that stable point. In some applications, it is known to combine the use of pipe piers and grouting. Thus, it is known to insert a pipe pier and then gravity fill the pipe with grout to gain greater stability through mass.

It has now been found that it is advantageous to not only fill such a pier with grout, but to force such grout into a volume surrounding both the head of the pier and the length thereof.

Inserting lengths of pier pipe is a time consuming process. In present commercial systems it is standard to force a short length of pipe into the ground, release the force thereon, loosen the pipe clamp, insert a new length of pipe, reclamp the pipe, re-apply pressure and so on. Thus, the present invention provides not only a pressure grouted pier, but a tool which simplifies and speeds the insertion and grouting process.

Figure 1:
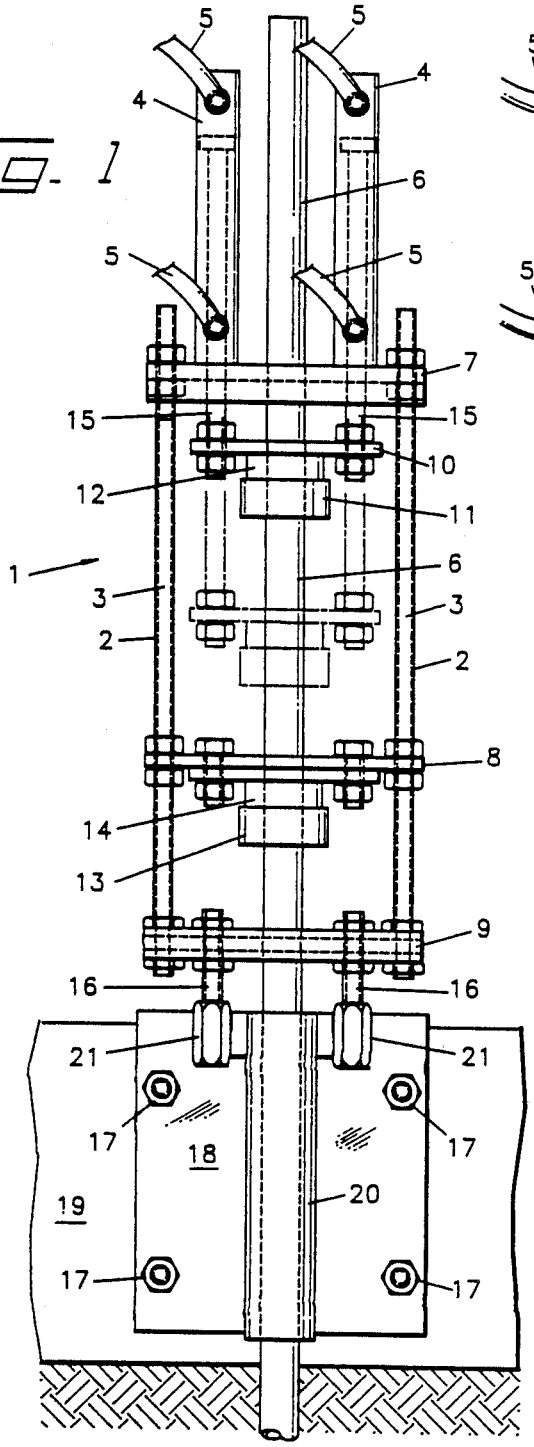
FIG. 1 is an elevation view of the apparatus of the invention shown mounted on a vertical surface of a foundation.
Figure 2:
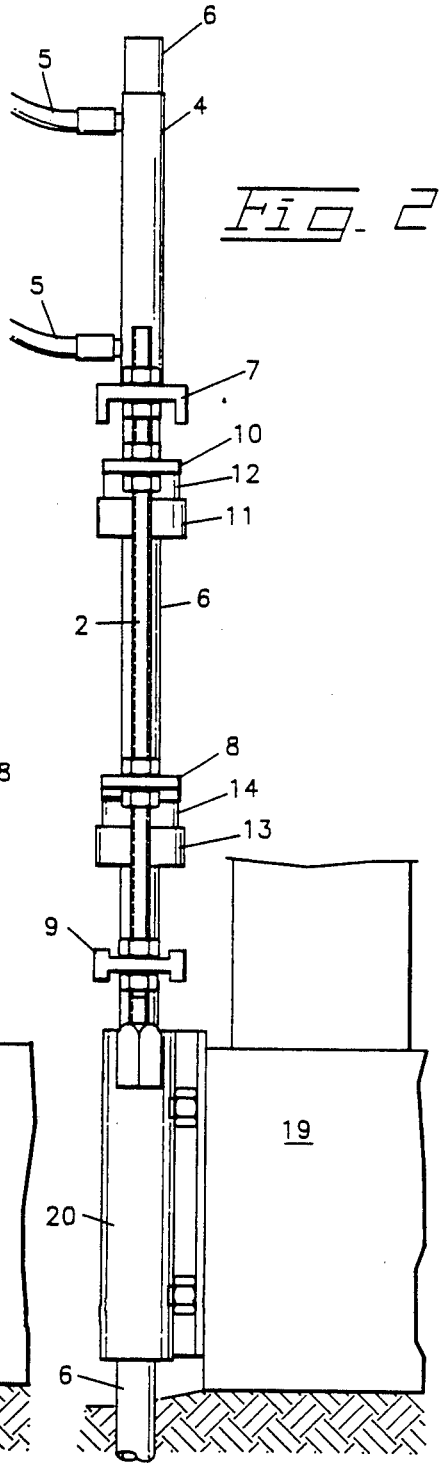
FIG. 2 is a side view of FIG. 1.

Referring to FIGS. 1 and 2, one embodiment of the pier inserting tool 1 is shown mounted to building foundation 19 by wall bracket 18, using bolts 17. The mounting of wall bracket 18 to foundation 19 in this manner is well known in the art. Bracket 18 includes a guide cylinder 20 through which pipe 6 is inserted and guided as it is forced by the apparatus into soil beneath the foundation.

Pier inserting tool 1 comprises two hydraulic rams 4 mounted on frame cross support 7, support 7 being held in place by lateral frame supports 2. Threaded bolts 3 (shown in dashed lines) pass through lateral frame supports 2 so that frame cross supports 7, 8 and 9 can be solidly fixed in position.

As can be seen in FIG. 1, pipe 6 is positioned between rams 4 and through each of supports 7, 8 and 9. Bolts 16 extending through cross support 9 pass into stationary nuts 21, which nuts have been fixed, as by welding, onto bracket 18, and more specifically adjacent guide cylinder 20. Thus, bolts 16 support inserting tool 1 above bracket 18.

Ram arms 15 move between an upper retracted position and a lower extended position. The lower position is shown in phantom. Clamp support 10 bridges between arms 15 and is fixedly mounted thereon. Upper clamp support extension 12 is a part of support 10, and extends downwardly therefrom to mate with pipe clamp collar 11, as is shown in greater detail in FIG. 3. By using such an arrangement, pipe clamp collar 11 may be used to grip pipe 6 as downward force is exerted by rams 15. Rams 15 are activated when a source of hydraulic pressure (not shown) transmits hydraulic fluid through pressure hoses 5 to rams 4. It is preferred that this double ram arrangement be used, since it exerts a balanced force on the pipe. Thus, while a single ram arrangement is possible, the use of at least two rams ensures the elimination of eccentric loading, at the same time providing greater driving force.

Figure 3:
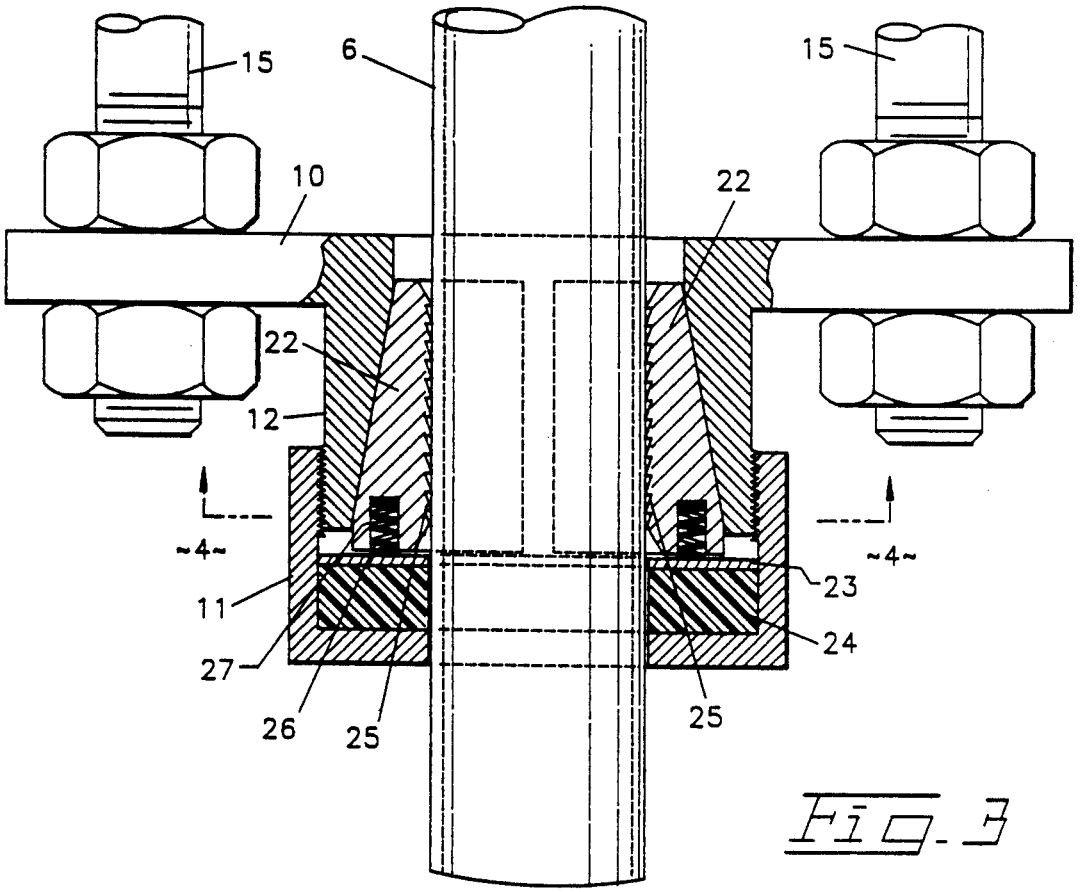
FIG. 3 is a partial cross-sectional view of the movable pipe clamp of the apparatus.

FIG. 3 shows in detail how clamp collar 11 is associated with clamp support extension 12 of clamp support 10. As can be seen, collar 11 is threaded on extension 12. Held within and supported by washers 23 and 24 are clamp inserts 22 having downwardly directed teeth 25 thereon. The inner surface of extension 12 is sloped so that teeth 25 are forced against the circumference of pipe 6 as collar 11 is screwed tighter onto extension 12. Thus, as ram arms 15 are extended when the clamp is in a tightened condition, pipe 6 is forced downwardly in a balanced manner. Further, once the ram arms have been fully extended, hydraulic pressure through pressure hoses 5 can be appropriately redirected so as to retract arms 15. Since teeth 25 are directed downwardly, clamp support 10 is retracted without retracting pipe 6. This is assisted by release of the downward force of the rams acting on clamp inserts 22, and by the upward releasing force of resilient plastic washer 24. If further force is necessary, springs 26 can be positioned in spring cavities 27, thereby applying additional releasing force.

While the particular type of clamp arrangement described has been found to be particularly advantageous, other clamps known in the art may be used, so long as the clamp is designed to allow balanced, one-way force directed downwardly around the pipe, which force is automatically released as the clamp is unloaded and retracted.

It has been found that for the present invention, washer 23 of FIG. 3 should be made of thin hard metal, such as steel, while washer 24 is thicker resilient plastic material which conforms, and distributes forces over, the space inside collar 11.

Figure 4:
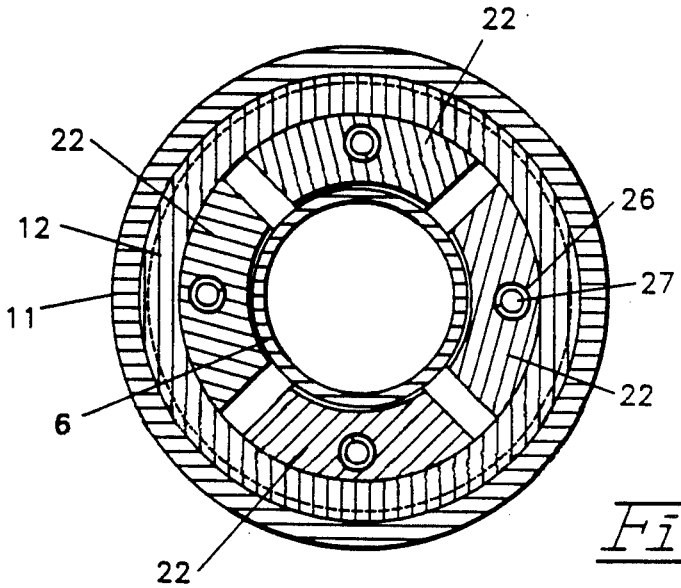
FIG. 4 is a cross section of FIG. 3 taken along line 4—4.

FIG. 4 is a cross-sectional view along line 4—4 of FIG. 3, showing the positioning of elements within the clamp. It is desirable to have a number of clamp inserts 22 to balance the forces on pipe 6. The dashed line within clamp support extension 12 is an indication of the threaded portion where clamp collar 11 and extension 12 mate. More or fewer clamp inserts can be used, as desired. The position of spring cavities 27 are also shown in FIG. 4.

To withstand load of up to 40,000 psi which are generated by hydraulic rams 4, the elements of the pier inserting tool desirably are made of hardened steel of the type well known in the art. In a preferred embodiment of the invention, ram arms 15 support one inch diameter threaded steel bolts, while clamp support 10, and supports such as 7, 8 and 9 (FIG. 1) are machined steel approximately ½ inch thick. Of course, these dimensions will vary with the necessary characteristics of a particular pipe inserting task.

Referring again to FIG. 1, it is particularly preferred that pier inserting tool 1 also includes a second clamp, positioned below and in axial alignment with the upper clamp elements, i.e., support 10, extension 12 and collar 11. Thus, shown bolted to frame cross support 8 is a lower clamp support 14 to which lower pipe clamp collar 13 is attached. Collar 13 and clamp support 14 are in all respects the same as collar 11 and clamp support 10 respectively, and have an internal construction identical to the structure shown in FIGS. 3 and 4. The only difference is that clamp elements 13 and 14 are stationary in this embodiment during the operation of hydraulic ram arms 15.

The use of a two clamp system provides a great advantage in that, once the pipe pier is driven via the movable clamp assembly, and the ram arms begin retraction, the load from the building foundation is automatically transferred to the stationary lower clamp. Once the upper clamp has been retracted and begins its next downward stroke, the downwardly projecting teeth of that clamp assembly solidly grip the pipe pier and the load is once again transferred from the lower clamp back to the upper clamp, the lower clamp releasing the load in the same manner as described above for the upper clamp. In doing so, the load of the foundation constantly remains on the pipe rather than being first transferred to the pipe as its is forced downward, being released as the ram is retracted, transferred back to the pipe for the next downward stroke, and so on.

This mode of operation minimizes flexing of the foundation being raised, thereby decreasing the possibility of stressing the foundation to the cracking point. This alternate automatic clamping of the invention also decreases operational dead time between force applications, allowing jobs to be completed more quickly.

Figure 5:
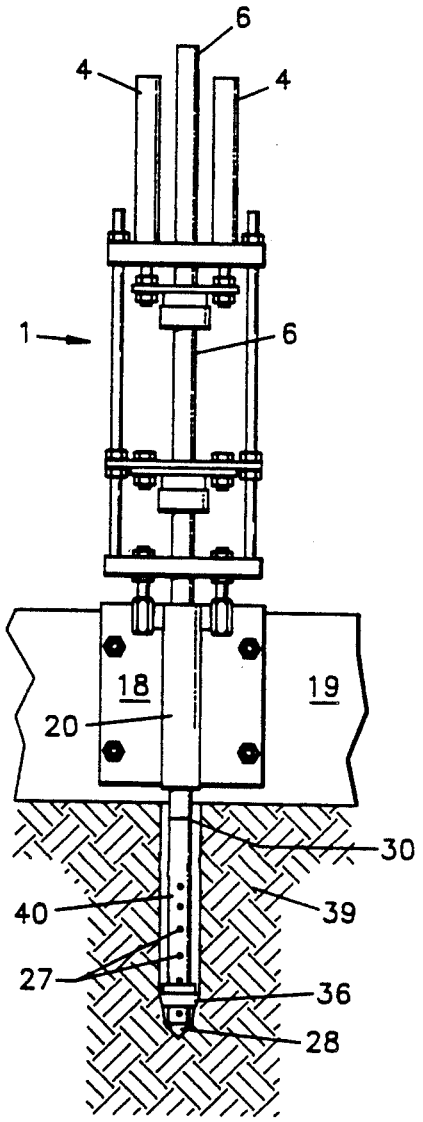
FIG. 5 is an elevation view of the apparatus showing the initial insertion of a pipe into the soil.
Figure 6:
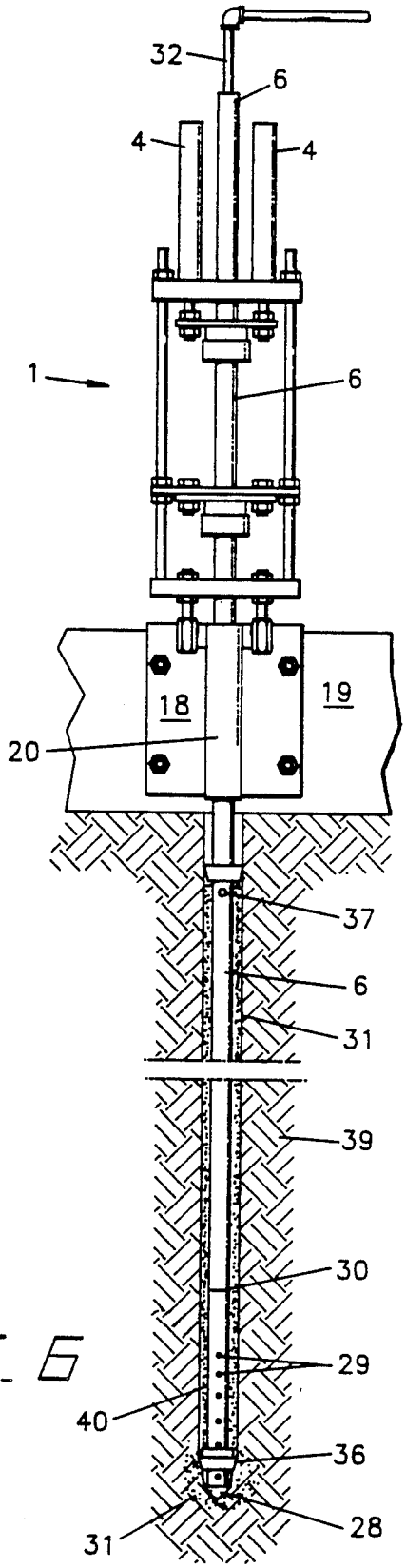
FIG. 6 is a view similar to FIG. 5 showing the pipe forced further into the soil and showing how pressure grouting is achieved.
Figure 7:
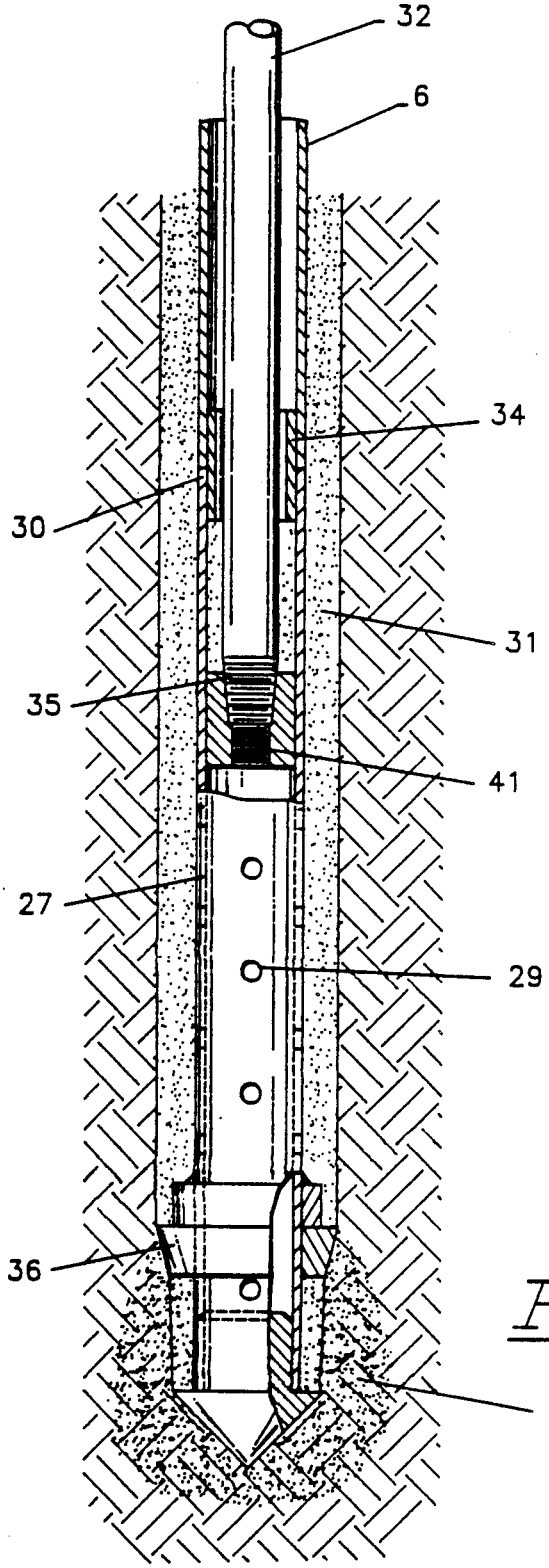
FIG. 7 is a close up view of the tip of the pipe in partial cross-section.

Referring now to FIG. 5, 6 and 7, the operation of the pier inserting tool can be described along with the methods of the invention. In FIG. 5 is can be seen that the double ram system of the preferred embodiment allows lengths of pipe 6 to be fed through inserting tool 1 while still having access to the top of a given length. Thus, the design does not limit the lengths which may be driven and fewer, longer, lengths may be used, if this is desired.

The numerals used in FIGS. 5, 6 and 7 are the same for the elements of the invention shown in FIGS. 1–4. In each of FIG. 5, 6 and 7 grout distributing pipe 40 is shown as the first length to be inserted. As is known in the art, a pointed pipe tip 28 is used to facilitate the downward progress of the pipe pier. Usually the pipe pier is driven through unstable soil 39 until sufficiently solid material, such as bedrock, is reached. Where this is not possible, however, it is advantageous to fill the pipe pier with cement grout after it is in place so as to increase the pipe pier's friction loading capability in the soil. Where soil 39 is particularly unstable or deep, it may further be desirable to pump grout through to the tip of the pipe pier and into the soil surrounding the tip. By doing so, water which would normally surround the tip displaced by structurally stable cement grout, thereby providing even greater stability, as well as corrosion protection.

In the preferred method of the invention it has been found that for certain soil conditions it is also advantageous to surround at least a portion of the exterior of the pipe with a sheath of grout. This outer sheath is formed by pressure grouting as the pier is inserted, or may be formed after full length insertion. The pressure grouted pier, including exterior grouting, has been found to perform well even under extremely adverse soil stability and in corrosive environments.

Thus, the method comprises the steps of inserting a length of pipe into the soil, the head portion of the pipe having holes therein to allow grout to pass out from the inside of the pipes to its exterior. As the pipe is inserted, an annular volume around the exterior of the pipe is cleared by use of a collar around a lead portion of the pipe. Grout is then pumped through the pipe to the exterior thereof, is fill that space.

To accomplish this method the perforated grout distribution pipe 40 (FIGS. 5–8) is used. A thrust collar 36 having a diameter greater than pipe tip 28 and pipe 6 is used to clear the volume surrounding the pipe for grout as the pipe is forced downwardly. Lower holes 29 allow grout pumped into the pipe pier via grouting hose 32 to pass into distributing pipe 40 and subsequently outside pipe 6 and into the space cleared by collar 36. A threaded connection 35 is welded within pipe 40 to which grouting hose 32 is mated. At joint 34 between pipe lengths, and between pipe 27 and subsequent lengths a pipe joint sealant 34 is applied. Alternatively pipe splices may be used, as described with respect to FIG. 8 below.

To ensure the formation of a continuous layer of grout surrounding the exterior of the length of the pipe pier, a hole 37 (FIGS. 6 and 8) perforates an upper portion along the length of pipe 6. As grout is forced through grouting hose 32 and distributing pipe 40, and is forced into the space around the pipe, the exterior grout level rises until it reaches hole 37. Hole 37 allows water and mud displaced by the grout to pour into the interior of pipe 6. Once the outer grout level has reached hole 37, where it is blocked from rising further by collar 38, grout likewise pours through the hole to fill the available interior of pipe 6. In doing so, water and mud are displaced through the open top of pipe 6.

Figure 8:
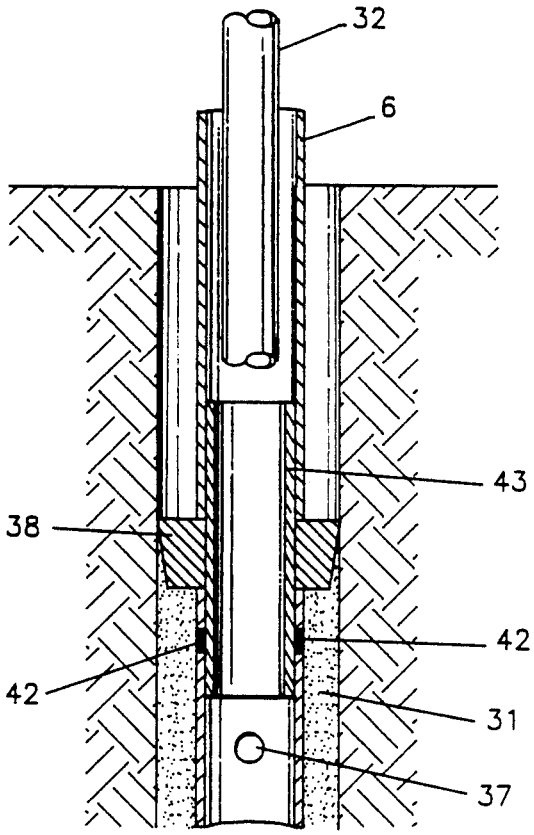
FIG. 8 is an upper portion of the driven pipe of FIG. 7 showing a pipe splice and the upper grout inlet to the pipe.

FIG. 8 shows how collar 38 is held in place between two lengths of pipe, using a plug weld 42 to hold a short piece of pipe splice 43. This type of splice/collar arrangement can be made at any splice along the length of the pipe pier so that any portion of that length may be pressure grouted and other portions may not.

Once grout reaches the desired level in pipe 6, the grouting hose is disconnected from threaded connection 35 and removed from the pipe.

Under some conditions it is desirable to provide additional internal support for the pier, and a tendon may be inserted into the interior of pipe 6 and mated with threads 42. Such a tendon is then bolted at the top of the pipe pier by use of a plate and nut so that the tendon is held solidly in place.

In operation, a first length of pipe following the grout distributing pipe 40 (usually nominal 2 inch extra strong, schedule 80, 3½ feet in length) is positioned through the pier inserting tool.

If the pipe is to be grouted while being driven, the grouting hose is attached within the pipe and force is applied by the dual rams, thereby activating the upper clamp. In this embodiment, the stroke length is approximately twelve inches. Once extended, the ram arms are retracted while the pipe is held in place by the lower clamp. Once the length of pipe has been forced into the ground, the grouting hose is removed, a new length of pipe is inserted through the apertured load plates and upper clamp, the grouting hose is reconnected, and the process is repeated. All of this is achieved with the load being maintained on the pipe by the bottom clamp.

While the pier inserting tool described herein is shown mounted by a side wall bracket, it is to be understood that the tool may also be mounted away from a wall, i.e., on a horizontal surface, by use of an appropriate bracket as is well known in the art. Except for such mounting, the tool itself is constructed in the same manner. In fact, the balanced forces applied by the double ram system, especially when used in combination with upper and lower clamps, make the invention especially useful for large surfaces of concrete, where such horizontal surface mountings may be required.

Figures 9, 10:
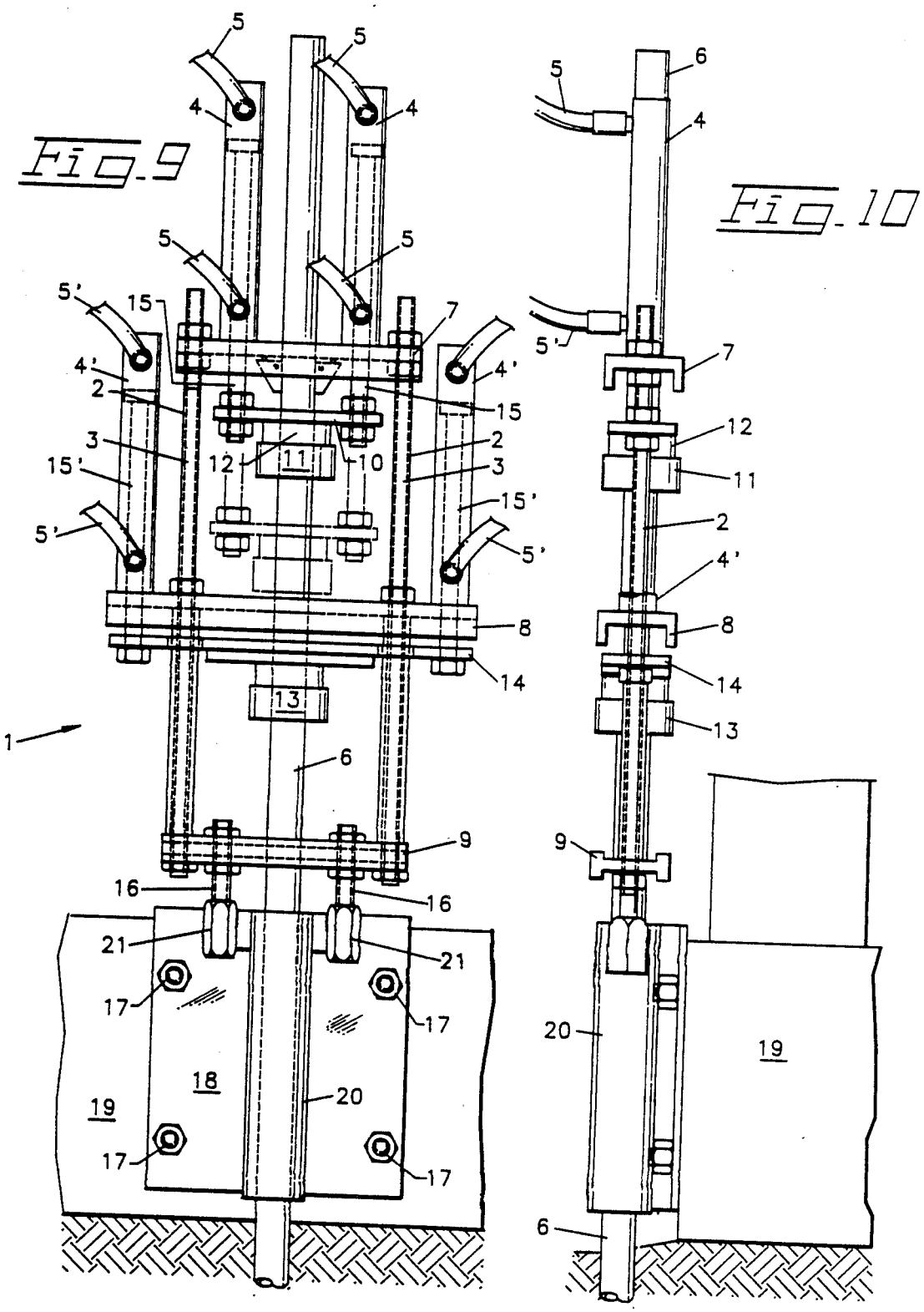
FIG. 9 is a front view of a modified version of the invention.
FIG. 10 is a side view of the tool of FIG. 9.

FIGS. 9 and 10 show a modification of the apparatus of the invention. Thus, in both FIGS. 9 and 10, many of the elements of the tool shown in FIGS. 1 and 2 are found, and these elements have been given the same numbers for ease of identification.

In particular, it will be recognized that the embodiment of FIGS. 9 and 10 uses the same basic structure as that of FIGS. 1 and 2, but is modified so as to make the lower clamp assembly independently movable in the direction the pipe is to be driven.

This results in a number of advantages. First, the tool can now be used to apply even greater pressure to the pipe, to overcome denser soils, when all rams are operated simultaneously and both the upper and lower clamps are driven in tandem.

Alternatively, the rams can be operated sequentially such that the lower ram is retracted as the upper rams are extended, and vice-versa. This allows for continuous driving of the pipe to be achieved. When used with the one-way clamps shown in FIGS. 3 and 4, the system can be set up to run virtually without need for intermittent adjustments while an entire pipe-pier is driven. This minimizes the need for personnel at the job site.

Thus, in FIG. 9, clamp support 14 has now been made movable and separate from load plate 8, such that lower clamp 13 is extended or retracted along with lower hydraulic ram arms 15'. Lower hydraulic rams 4' are operated by use of a hydraulic pump (not shown), via pressure hoses 5'. Lower hydraulic rams 4' operate in all respect like upper rams 4, it being understood, however, that there may be applications for which different capacity rams might be used.

FIG. 10 is a side view of the tool of FIG. 9, shown in partial cut-away. Compared to the embodiment of FIG. 2, it will be noted that only the relationship between clamp support 14 and load plate 8 has changed. Lower hydraulic ram 4' is shown in partial cut-away.

In use, the embodiment of FIGS. 9 and 10 provides a great number of useful options for the user. As mentioned, the user is usually limited by the capacity of the hydraulic pump being used, since that pump must be carried from job to job, and to various locations at a job.

By using the double-dual ram/two clamp arrangement the tool is much more flexible. For example, it is generally desirable to operate using 20,000 P.S.I. of force on the pipe as it is driven. In the embodiment of FIG. 1, a pump having a pumping capacity sufficient to generate 10,000 P.S.I. at each ram will operate to move the rams at an insertion rate of about one foot per minute. Greater force can be generated, but only by operating the pump at a slower rate. Conversely, a smaller driving force can be used for some jobs with an increase in speed.

In any case, however, using the embodiment of FIG. 1, the rams must be retracted between strokes.

Using the embodiment of FIG. 9, on the other hand, the same capacity pump may be used to sequentially and continuously move the rams at the same rate of one foot per minute, but saving the time previously used for retraction. Alternatively, the rams could be used concurrently, thereby generating a total force of 40,000 P.S.I. while maintaining the one foot per minute rate while driving. Another alternative would be to lower the pump output (or, conveniently, use a small higher capacity, more portable, pump) to a level such that only 5,000 P.S.I. is generated at each ram. Using this arrangement, the same total of 20,000 P.S.I. is generated, but at about 2.5 feet per minute when the ram pairs are run sequentially. Pressures of 40,000 P.S.I. are generated at the same driving rate (but with interim retractions) where the ram pairs are used together.

This flexibility allows the operator to choose varying degrees of speed of operation, safety factors (using lower pressures), total driving pressures, and portability of the equipment, thereby providing a much more efficient operation.

While only two embodiments of the pipe pier driving tool, and a single embodiment of the pressure grouted pier and method of inserting such pipes to add support to existing structures have been described, it is noted that many modifications to the invention can be made without departing from the spirit thereof, and such modifications are intended to be within the scope of the appended claims.

For example, the pressure grouted pier may also include a larger diameter plastic or steel sleeve which is forced by the pier inserting tool around an upper (non-grouted) portion of the pipe so as to provide greater resistance in particular environments. Such a sleeve is easily inserted using pipe clamp collars having a larger diameter. A series of sizes of such clamp collars allows pipes of varying diameters to be used as piers according to the invention. Further, the method of the invention described above with respect to the embodiment of FIG. 1 can be modified to utilize the tool of FIG. 9 such that the method may include the step of operating the first and second driving means either sequentially or together, rather than simply holding the pipe with the lower (stationary) clamp while the driving means (of FIG. 1) is retracted.

What is claimed is:

1. A pipe pier inserting tool comprising:
a supporting frame defining a pipe driving axis;
means for coupling said frame to a load;
first means coupled to said frame for driving a pipe along said pipe driving axis;
first coupling means for coupling said pipe to said first means for driving, said first coupling means being extendably engaged with said first means for driving, for extension and retraction thereby, said first coupling means being adapted to grip said pipe when said means for driving is forced to an extended position, and to release said pipe when said means for driving is retracted;
second means coupled to said frame for driving said pipe along said pipe driving axis; and
second means for coupling said pipe to said second driving means, said second coupling means being extendably engaged with said second driving means, for extension and retraction thereby, said second coupling means being adapted to grip said pipe when said means for driving is forced to an extended position, and to release said pipe when said second driving means is retracted.

2. A pipe inserting tool as in claim 1 wherein said second coupling means is adapted to grip said pipe when said first means for coupling is retracted, and to release said pipe when said first coupling means is extended.

3. A pipe pier inserting tool as in claim 1, wherein each of said first and second coupling means comprise annular clamps positioned to surround said pipe, each clamp including pipe gripping inserts having teeth disposed thereon angled in the direction said pipe is to be driven.

4. A pipe pier inserting tool as in claim 1 wherein each of said first and second driving means comprises at least one hydraulic ram supported by one of said frame cross members.

5. A pipe pier inserting tool as in claim 1 wherein each of said first and second driving means comprises a pair of hydraulic rams, each of said first and second driving means being supported by one of said frame cross members.

6. The process of underpinning and raising portions of a building foundation as in claim 1 wherein said first and second driving means are operated in tandem.

7. A pipe pier inserting tool comprising:
a supporting frame adapted to be coupled to a load and defining pipe driving axis;
first means for releasably coupling a pipe to be driven to said frame disposed along said pipe driving axis;
first means for driving said pipe along said axis, said first means for driving being coupled to said frame and in extendable and retractable engagement with said first means for coupling;
second means for releasably coupling said pipe to said frame disposed along said pipe driving axis; and
second means for driving said pipe along said axis, said second means for driving being coupled with said frame and in extendable and retractable engagement with said second means for coupling.

8. A pipe pier inserting tool as in claim 7, wherein said supporting frame comprises at least two stationary frame support members held in spaced parallel relationship by lateral frame support members, each of said frame cross support members extending across said pipe driving axis and having a hole therethrough at said axis to allow said pipe to be driven to pass therethrough.

9. A pipe pier inserting tool as in claim 7 wherein each of said first and second means for releasably coupling said pipe comprises an annular clamp.

10. A pipe pier inserting tool as in claim 7 wherein each of said driving means comprises at least one hydraulic ram supported by one of said frame cross members.

11. A pipe pier inserting tool as in claim 7 wherein each of said first and second driving means comprises a pair of hydraulic rams, each of said first and second driving means being supported by one of said frame cross members.

12. The process of underpinning and raising portions of a building foundation resting on underlying soil comprising the steps of:
boring a hole in said foundation, the length of said hole defining a pipe driving axis;
mounting a pipe driver adjacent said hole, said pipe driver including first and second means for gripping a pipe and first and second means for driving a pipe, said first gripping means being extendably connected to said first driving means, and said second gripping means being extendably connected to said second driving means, and each of said gripping means being disposed along said pipe driving axis;
inserting a pipe axially into said pipe driver along said pipe driving axis;
gripping said pipe with said first gripping means;
driving the length of said pipe through said hole in said foundation by forcing said first driving means to an extended position;

gripping said pipe with said second gripping means; and driving the length of said pipe through said hole in said foundation by forcing said second driving means to an extended position.

13. The process of underpinning and raising portions of a building foundation as in claim 11 wherein said first and second driving means are operated sequentially whereby each of said first and second driving means is alternately forced to an extended position, while the other is retracted, so as to continuously force said pipe through said hole in said foundation.

14. A method of forming a pressure grouted pier comprising:

a. inserting a length of perforated pipe into the soil;

b. providing a volume surrounding at least a portion of the exteriors of the length of said pipe that is free of soil;

c. forcing grout through said perforations in said pipe and into said volume; and d. inserting a sleeve to surround said pipe along a non-grouted portion of the length of said pipe.

* * * * *